US009651897B2

(12) United States Patent
Iketani

(10) Patent No.: US 9,651,897 B2
(45) Date of Patent: May 16, 2017

(54) IMAGE FORMING APPARATUS APPARATUS POSITIONING MAGNETS BY CONTACT FACES OF SHAFT AND BEARING AND RESTRAINING ACTION OF FORCE FROM GUIDE PART BY CLEARANCE BETWEEN SHAFT AND BEARING

(71) Applicant: KYOCERA Document Solutions Inc., Osaka (JP)

(72) Inventor: Takeshi Iketani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/061,468

(22) Filed: Mar. 4, 2016

(65) Prior Publication Data

US 2016/0266520 A1 Sep. 15, 2016

(30) Foreign Application Priority Data

Mar. 10, 2015 (JP) ..... 2015-046745

(51) Int. Cl.
*G03G 15/09* (2006.01)
*G03G 15/08* (2006.01)

(52) U.S. Cl.
CPC ..... *G03G 15/0921* (2013.01); *G03G 15/0812* (2013.01); *G03G 15/0935* (2013.01)

(58) Field of Classification Search
CPC combination set(s) only.
See application file for complete search history.

(56) References Cited

U.S. PATENT DOCUMENTS

2007/0166070 A1* 7/2007 Sato ..... G03G 21/1821 399/90

FOREIGN PATENT DOCUMENTS

JP 01149076 A * 6/1989
JP 2002-304060 A 10/2002

* cited by examiner

*Primary Examiner* — Clayton E LaBalle
*Assistant Examiner* — Victor Verbitsky
(74) *Attorney, Agent, or Firm* — Studebaker & Brackett PC

(57) ABSTRACT

An image forming apparatus includes an image carrier, a development device and a guide part guiding the development device to the image carrier. The development device includes a magnet roller, which includes a shaft having magnets arrayed circumferentially, and a cover member, which include a bearing part engaged with the guide part as the shaft is inserted thereinto. The shaft and the bearing part include an engaged part and an engaging part restricting a circumferential position of the magnet and including contact faces provided along an action direction of force from the guide part to the bearing part when the bearing part is engaged with the guide part and the development device approaches the image carrier. A clearance is provided between an outer circumferential face of the shaft and an inner circumferential face of the bearing part at an upstream side in the action direction from the contact faces.

6 Claims, 11 Drawing Sheets

IMAGE FORMING APPARATUS APPARATUS POSITIONING MAGNETS BY CONTACT FACES OF SHAFT AND BEARING AND RESTRAINING ACTION OF FORCE FROM GUIDE PART BY CLEARANCE BETWEEN SHAFT AND BEARING

INCORPORATION BY REFERENCE

This application is based on and claims the benefit of priority from Japanese Patent application No. 2015-046745 filed on Mar. 10, 2015, the entire contents of which are incorporated herein by reference.

BACKGROUND

The present disclosure relates to an image forming apparatus including a development device developing an electrostatic latent image formed on an image carrier by a developer.

An electro-photographic image forming apparatus is provided with a development device developing an electrostatic latent image formed on an image carrier by a developer. In the development device, the developer is carried on a developer carrier and is supplied to the electrostatic latent image formed on the image carrier. Such a developer carrier may be configured so as to include a rotatable nonmagnetic cylindrical sleeve and a magnet roller fixedly disposed inside the cylindrical sleeve and to carry the developer on a surface of the cylindrical sleeve by magnetic force generated by the magnet roller. The magnet roller has a plurality of magnetic poles arrayed along a circumferential direction of a shaft, and the respective magnetic poles are positioned so as to be located at predetermined positions.

For example, there is a development device configured such that one end of a shaft of a magnet roller is cut and formed into a D-shape, and a position adjusting member provided with an opening engaging with the D-cut end is used to position magnetic poles of the magnet roller. The position adjusting member is a plate metal member such as a plate spring and is used as a conduction member with a restricting blade restricting a thickness of a layer of the developer carried on a surface of a cylindrical sleeve. However, this development device has a problem that the plate spring-like position adjusting member needs to be formed by using metal molds, and thus a cost is increased.

Then, as the position adjusting member, there is a case where a resin-made cover member provided with a hollow boss-like bearing part engaged with a D-cut end is used. In this case, the development device is attached to an apparatus main body of the image forming apparatus by engaging the bearing part with rails provided in the apparatus main body. It is noted that in the case where the resin-made position adjusting member is used, a spring wire is used as a separate member to obtain conduction with the restricting blade.

SUMMARY

In accordance with an embodiment of the present disclosure, an image forming apparatus includes an image carrier rotatably supported centering on a spindle; a development device developing an electrostatic latent image formed on the image carrier; and a guide part guiding the development device in an approaching direction to the image carrier in a direction orthogonal to an axial direction of the spindle. The development device includes a magnet roller and a cover member. The magnet roller includes a shaft on which magnets are arrayed along a circumferential direction and a rotation sleeve incorporating the shaft to carry a developer on a surface of the rotation sleeve by a magnetic force of the magnets. The cover member includes a bearing part formed into a hollow boss-like shape projecting to the outside in an axial direction of the shaft and engaged with the guide part as an end part of the shaft is inserted into the bearing part. The end part of the shaft and the bearing part include an engaged part and an engaging part formed respectively so as to come into face contact with each other and so as to restrict a position of the magnet in the circumferential direction of the shaft. The engaged part and the engage part include respective contact faces provided along an action direction of a force acting from the guide part to the bearing part when the bearing part is engaged with the guide part and the development device approaches the image carrier. The development device is configured so that a clearance is provided between an outer circumferential face of the shaft and an inner circumferential face of the bearing part at an upstream side in the action direction of the force from the contact faces of the engaged part and the engaging part.

The above and other objects, features, and advantages of the present disclosure will become more apparent from the following description.

DETAILED DESCRIPTION

In the following, with reference the drawings, an image forming apparatus according to an embodiment of the present disclosure will be described.

Figure 1:
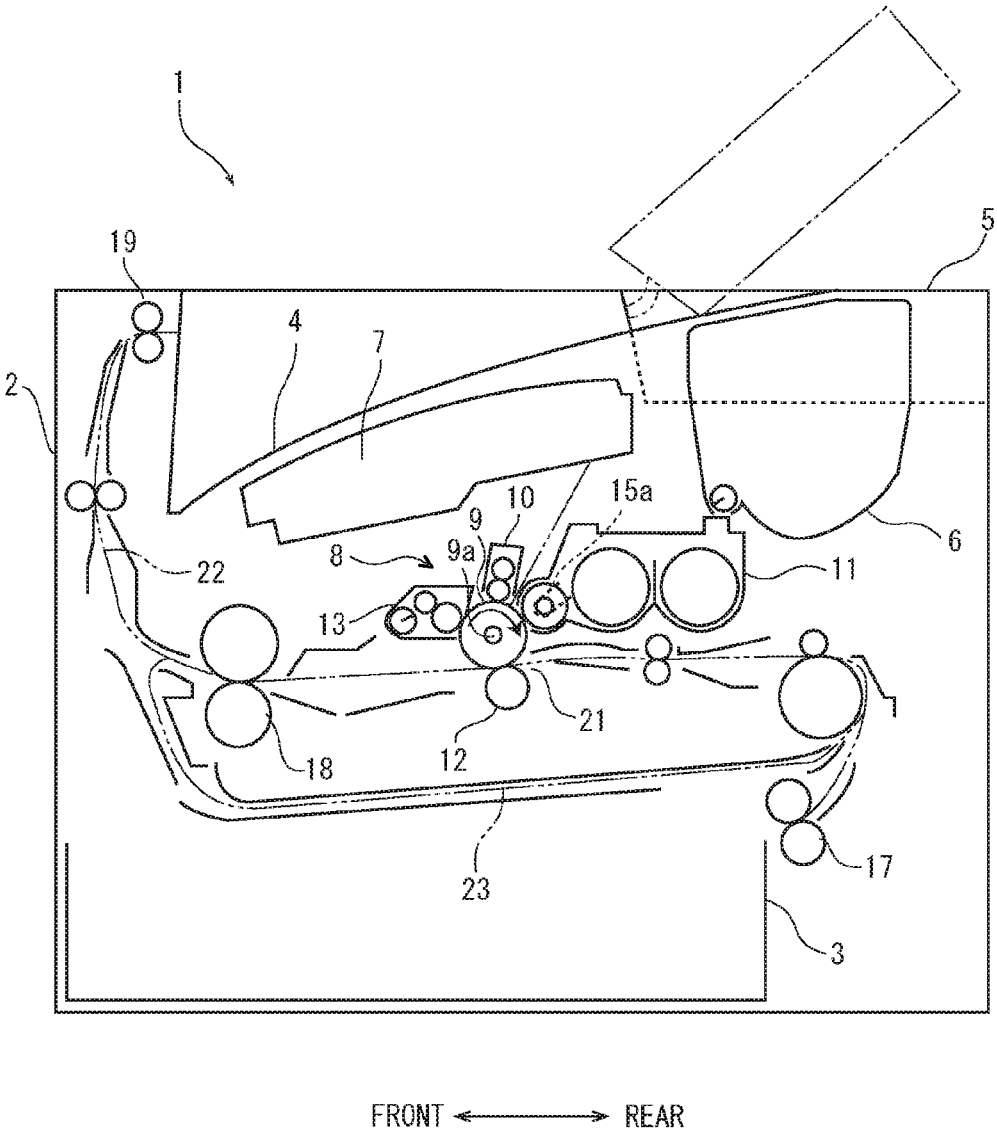
FIG. 1 is a front sectional view schematically showing an internal structure of an image forming apparatus according to an embodiment of the present disclosure.

First, with reference to FIG. 1, the entire structure of a printer 1 (an image forming apparatus) will be described. FIG. 1 is a schematic diagram showing the printer 1. Hereinafter, it will be described so that the front side of the printer 1 is positioned at a left side on the sheet of FIG. 1 and that left and right directions is defined as viewed from the front side of the printer 1.

The printer 1 includes a box-like formed printer main body 2 (an apparatus main body) having a front and back side plates and left and right side plates 2*a*. In a lower part of the printer main body 2, a sheet feeding cartridge 3 storing recording sheets (recording mediums) is installed. In an upper face of the printer main body 2, an ejected sheet tray 4 is formed. In the rear of the ejected sheet tray 4, an upper cover 5 is openably/closably attached. Below the upper cover 5, a toner container 6 is attachably/detachably installed.

In an upper part inside the printer main body 2, an exposure device 7 composed of a laser scanning unit (LSU) is located. Below the exposure device 7, an image forming part 8 is arranged. In the image forming part 8, a photosensitive drum 9 as an image carrier is rotatably arranged. Around the photosensitive drum 9, a charging device 10, a development device 11, a transfer roller 12 and a cleaning device 13 are located along a rotating direction (refer to an arrow in FIG. 1) of the photosensitive drum 9.

Below the image forming part 8, a sheet feeding part 17 feeding the sheet from the sheet feeding cartridge 3 is arranged. In front of the image forming part 8, a fixing device 18 is arranged. Above the fixing device 18, a sheet ejecting part 19 facing to the ejected sheet tray 4 is arranged. In addition, a conveying path 22 for the sheet is arranged so as to pass from the sheet feeding part 17 through a transferring part composed of the photosensitive drum 9 and the transfer roller 12 and through the fixing belt 18 toward the sheet ejecting part 19. Below the conveying path 22, an inversion path 23 for duplex printing is arranged.

Next, image forming operation of the printer 1 including such a configuration will be described. First, the surface of the photosensitive drum 9 is electrically charged by the charging device 10. Then, photographic exposure corresponding to the image data is carried out to the photosensitive drum 9 by a laser light (refer to a two-dot chain line P in FIG. 1) from the exposure device 7, thereby forming an electrostatic latent image on the surface of the photosensitive drum 9. The electrostatic latent image is developed to a toner image by the development device 11 using a toner supplied from the toner container 6.

On the other hand, the sheet picked up from the sheet feeding cartridge 3 by the sheet feeding device 17 is conveyed to the transferring part 21 along the conveying path 22 in a suitable timing for the above-mentioned image forming operation. In the transferring part 21, the toner image on the photosensitive drum 9 is transferred onto the sheet. The sheet with the transferred toner image is conveyed to a downstream side in the conveying path 22 to go into the fixing device 18. In the fixing device 18, the toner image is fixed on the sheet in the fixing device 16. The sheet with the fixed toner image is ejected from the sheet ejecting part 19 to the sheet ejected tray 4. Incidentally, the toner remained on the photosensitive drum 9 is collected by the cleaning device 13.

Figure 2:
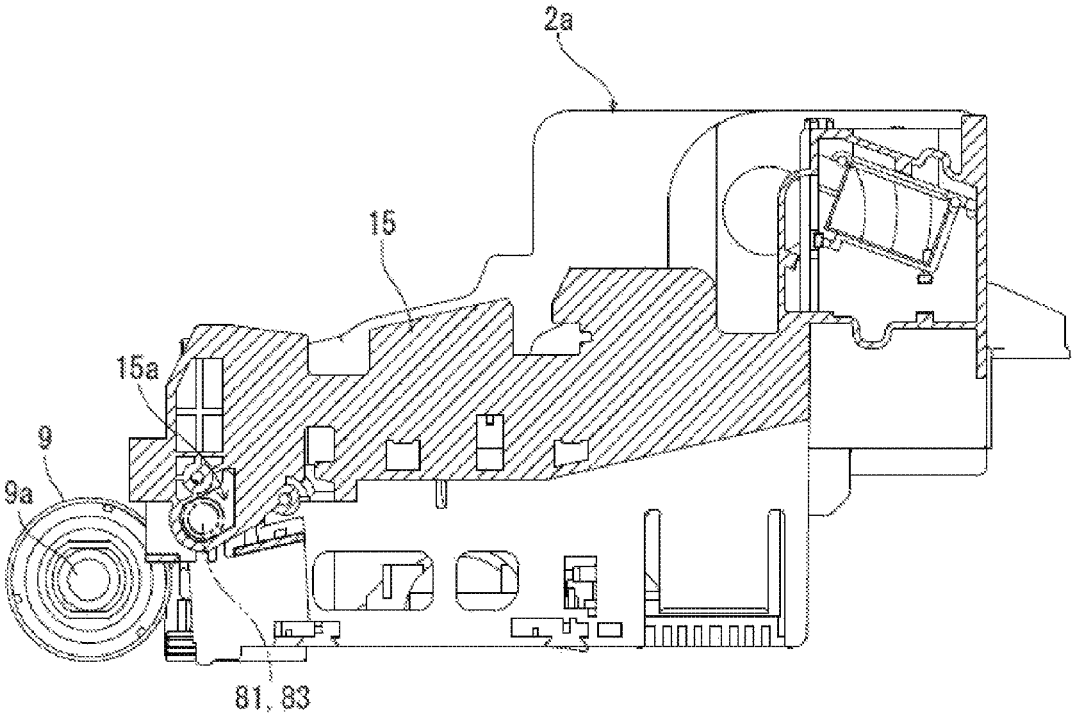
FIG. 2 is a front view showing a guide hole guiding a development device in the image forming apparatus according to the embodiment of the present disclosure.
Figure 3:
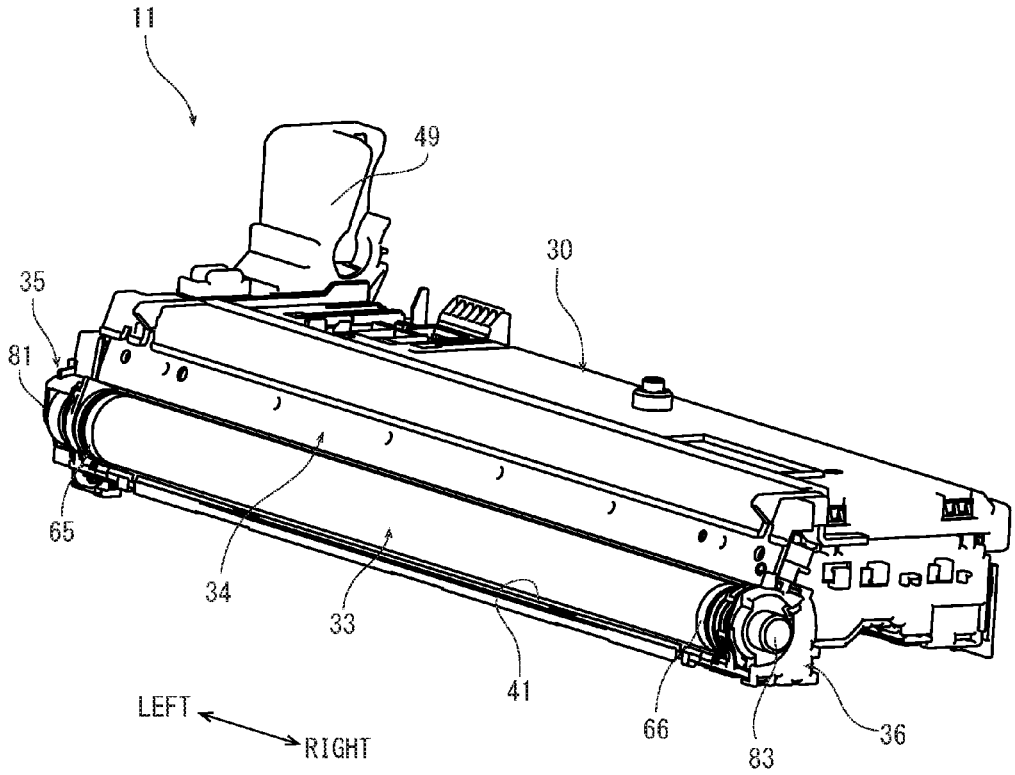
FIG. 3 is a perspective view showing the development device in the image forming apparatus according to the embodiment of the present disclosure.
Figure 4:
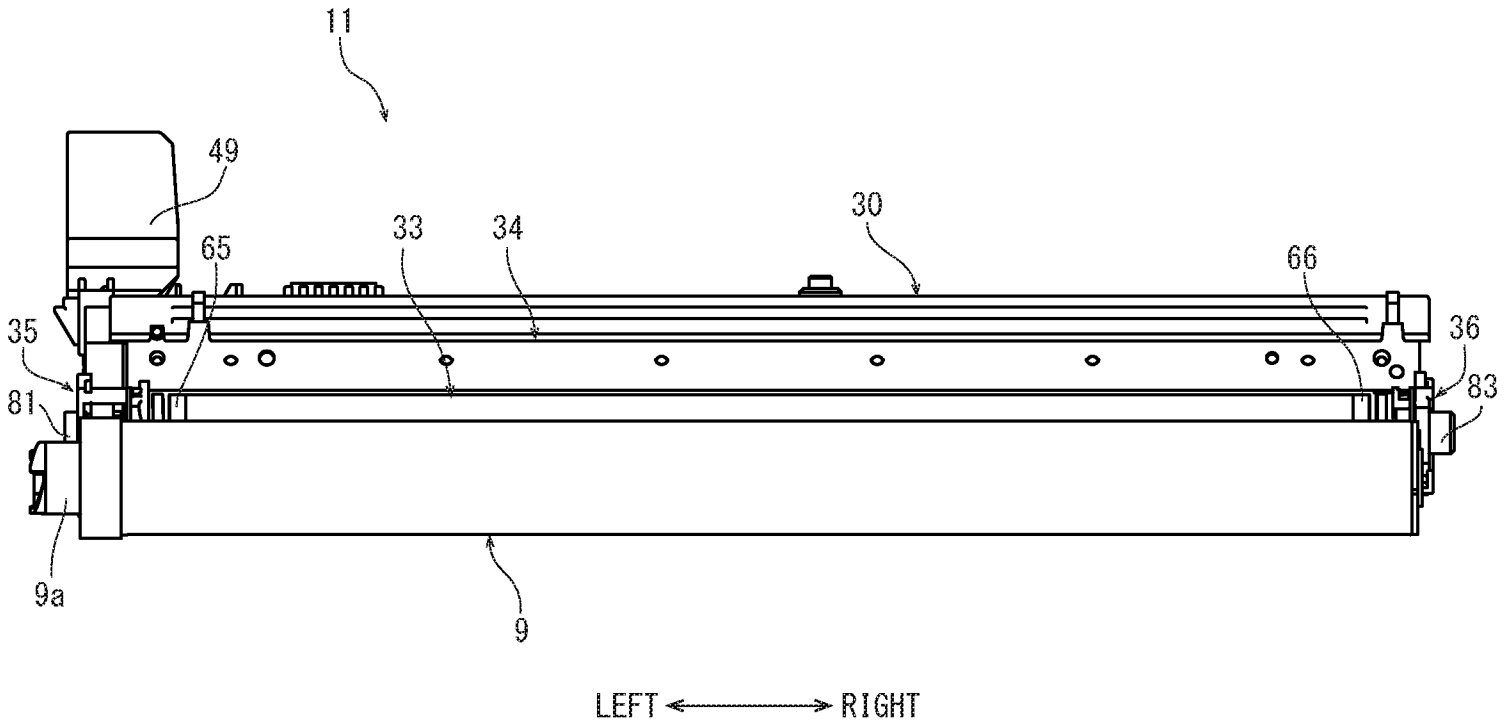
FIG. 4 is a front view showing the development device in the image forming apparatus according to the embodiment of the present disclosure.
Figure 5:
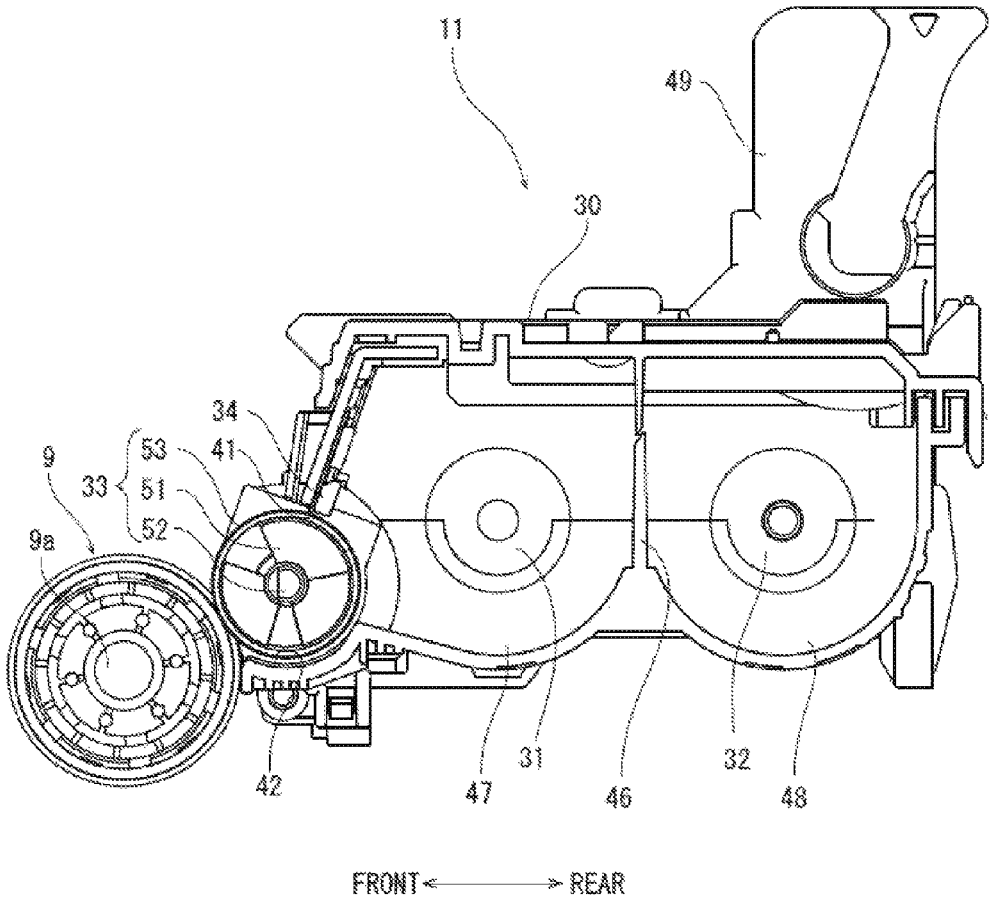
FIG. 5 is a lateral sectional view showing the development device in the image forming apparatus according to the embodiment of the present disclosure.
Figure 6:
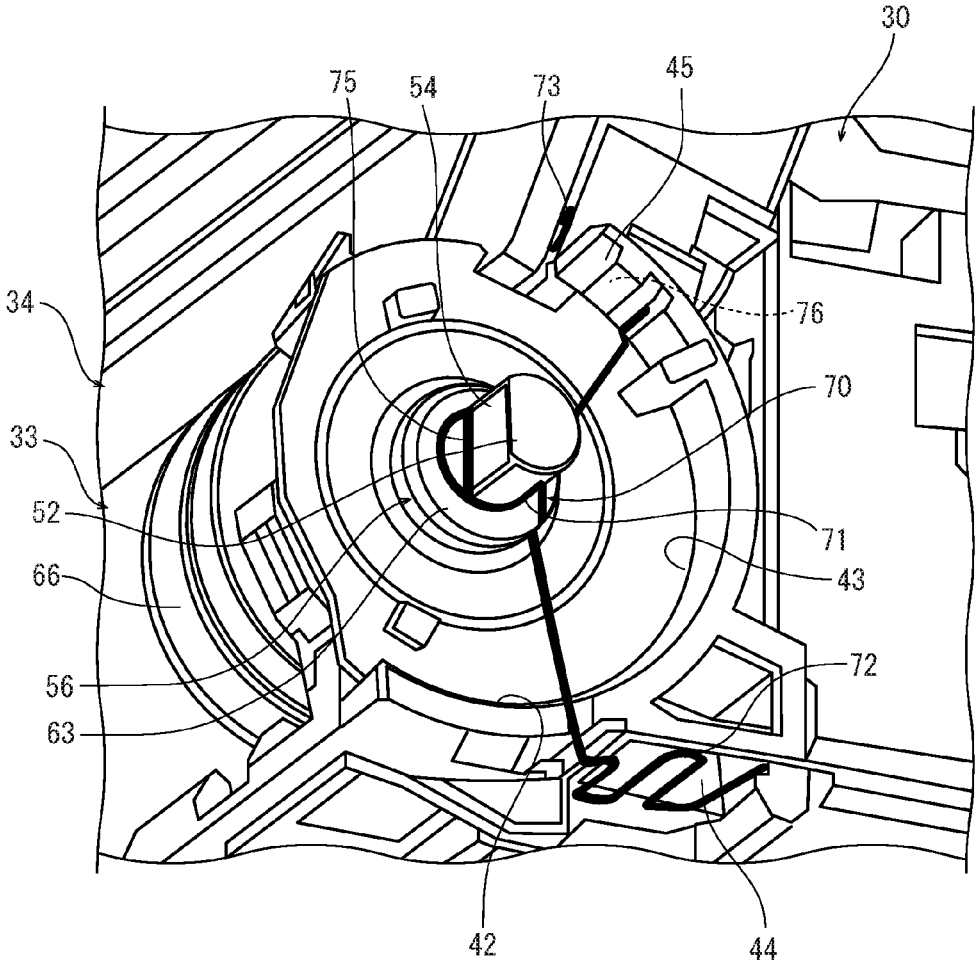
FIG. 6 is a perspective view showing a right end part of a housing main body of the development device in the image forming apparatus according to the embodiment of the present disclosure.
Figure 7:
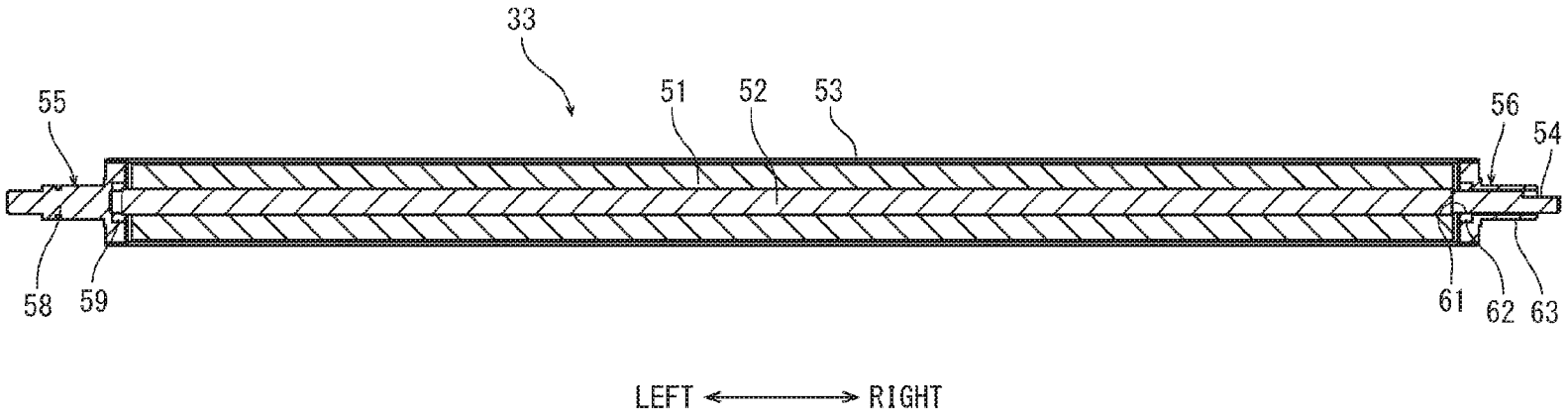
FIG. 7 is a front sectional view showing a magnet roller of the development device in the image forming apparatus according to the embodiment of the present disclosure.
Figure 8:
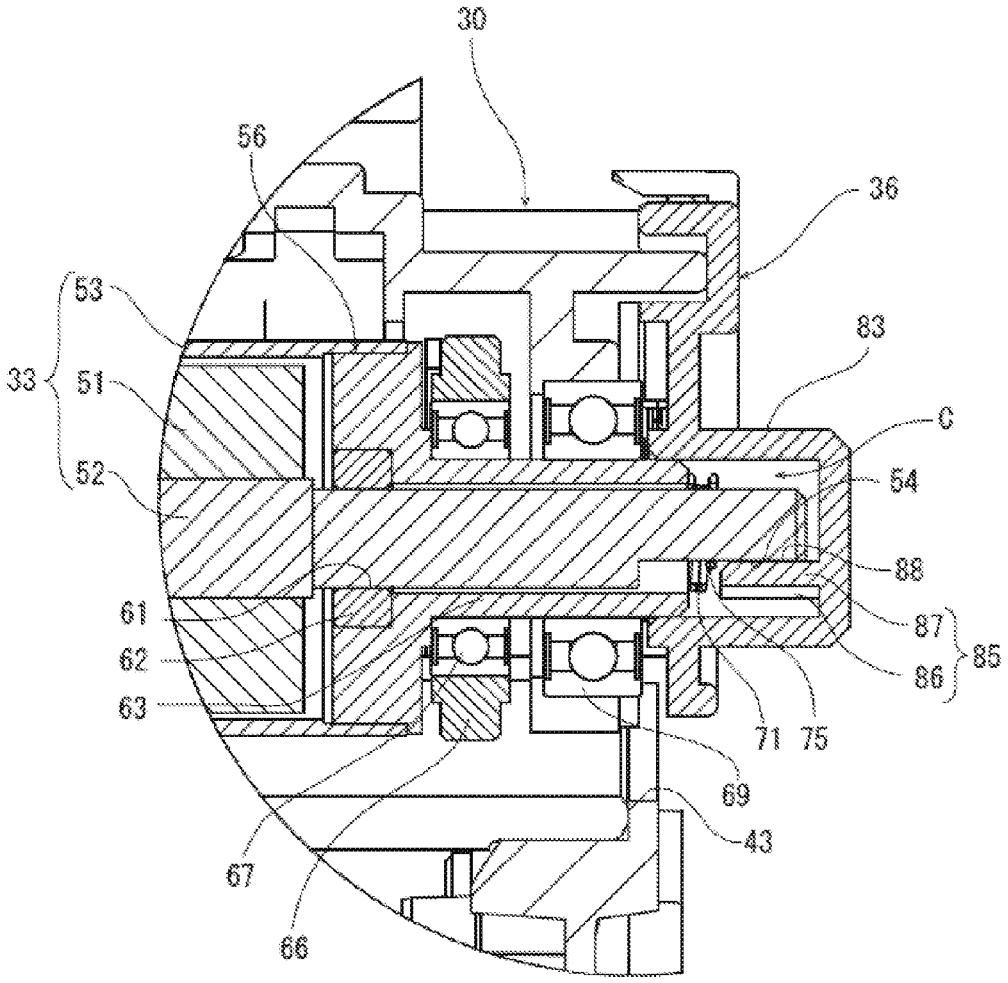
FIG. 8 is a plan sectional view showing a right end part of the magnet roller and a right cover member of the development device in the image forming apparatus according to the embodiment of the present disclosure.
Figure 9A:
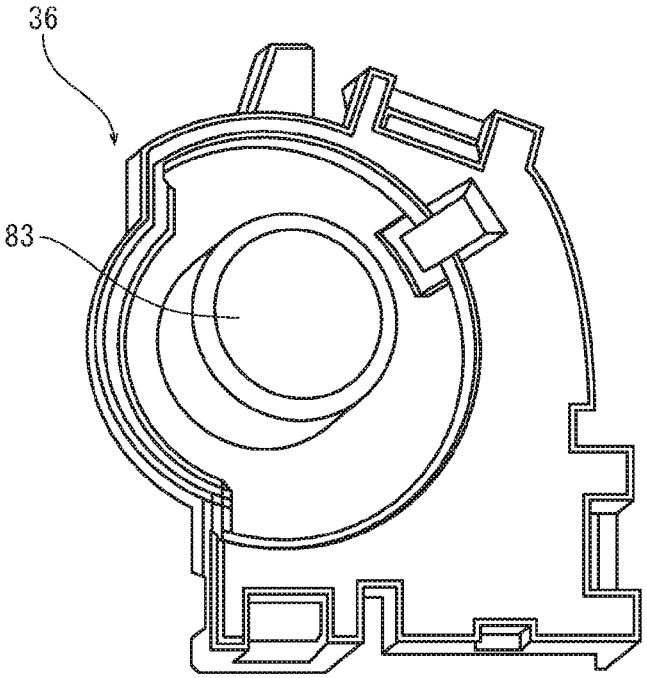
FIG. 9A is a perspective view showing the right cover member of the development device as viewed from the outside and FIG. 9B is a perspective view showing the right cover member of the development device as viewed from the inside, in the image forming apparatus according to the embodiment of the present disclosure.
Figure 9B:
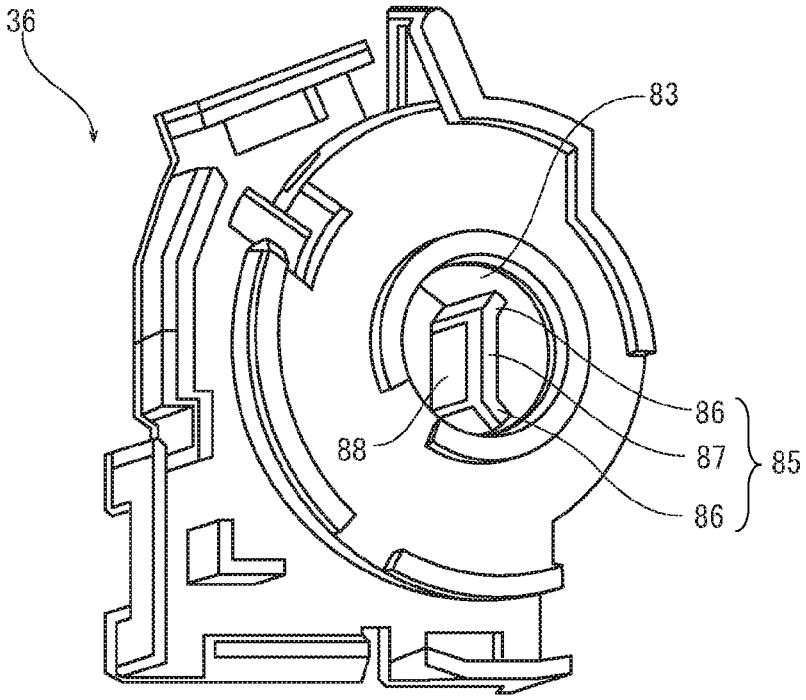
Figure 10:
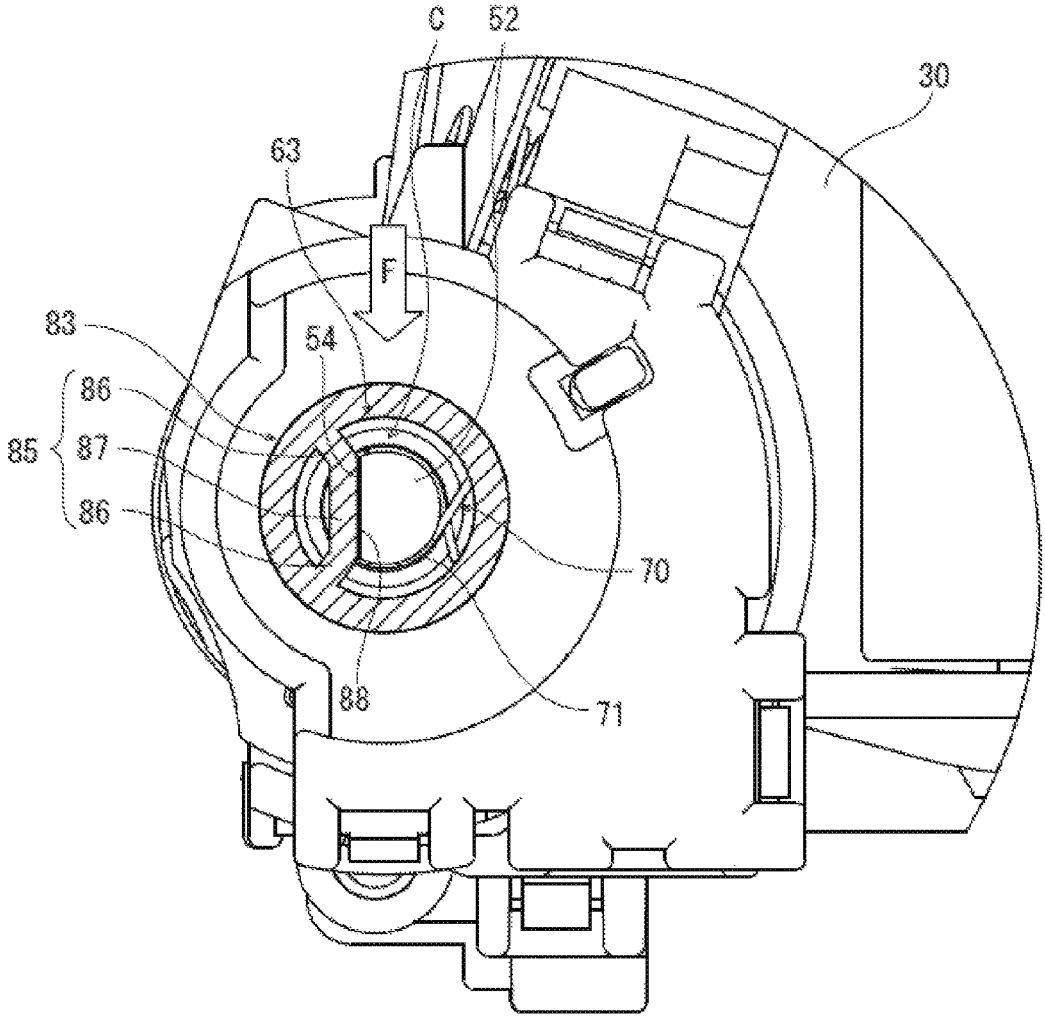
FIG. 10 is a lateral sectional view showing the right cover member of the development device in the image forming apparatus according to the embodiment of the present disclosure.
Figure 11:
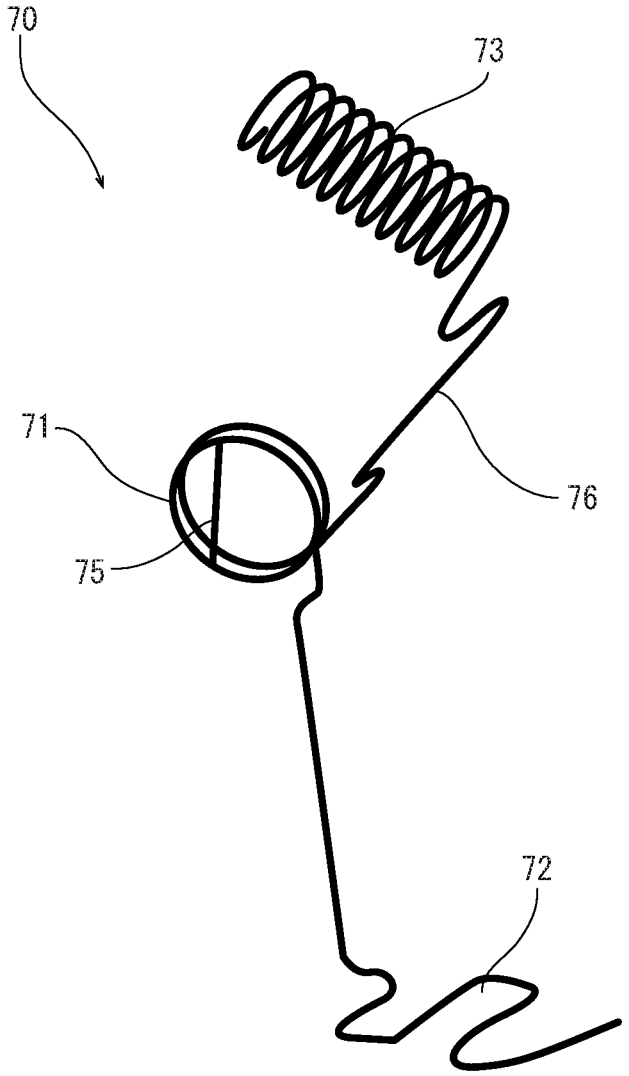
FIG. 11 is a perspective view showing a spring member of the development device in the image forming apparatus according to the embodiment of the present disclosure.

Next, with reference to FIGS. 2-11, the development device 11 will be described. FIG. 2 is a front view showing a guide part of the development device. FIG. 3 is a perspective view of the development device. FIG. 4 is a front view of the development device. FIG. 5 is a lateral sectional view of the development device. FIG. 6 is a perspective view of the development device. FIG. 7 is a front sectional view of a magnetic roller. FIG. 8 is a front sectional view of a right end part of the development device. FIGS. 9A and 9B are perspective views of right cover member. FIG. 10 is a lateral sectional view of the right end part of the development device. FIG. 11 is a perspective view of a spring member. Incidentally, in FIGS. 2 4 and 5, the photosensitive drum 9 is also illustrated.

The development device 11 is attached to or detached from the printer main body 2 from an obliquely upper back side with respect to the photosensitive drum 9. In respective inside faces of the left and right side plates 2*a* of the printer main body 2, as shown in FIG. 2, left and right guide plates 15 extending from the obliquely upper back side to the photosensitive drum 9 are provided. In end parts at a side of the photosensitive drum 9 of the respective guide plate 15, guide holes 15*a* (guide part) extending to an obliquely left lower side toward the photosensitive drum 9 are formed.

The development device 11 includes a container main body 30 in which the developer is stored, a first agitating screw 31 and a second agitating screw 32 disposed inside the container main body 30 in parallel in the forward and backward directions, a magnet roller 33 disposed in front of the respective agitating screws 31 and 32, a restricting blade 34 disposed so as to face to the magnet roller 33, left and right cover members 35 and 36 attached to the container main body 30 at both left and right end parts of the magnet roller 33.

The container main body 30 has a laterally long front sectional shape and is a hollow member formed in a rectangular parallelepiped shape elongated in a horizontal direction. In a lower part of a front side plate of the container main body 30, an opening part 41 extending in the left and right directions is formed. In a bottom plate of the container main body 30, a concave part 42 having a roughly semicircular front shape is formed so as to face to the opening part 41. In addition, in front end parts of left and right side plates of the container main body 30, respective openings 43 are formed (refer to FIGS. 6 and 8, the opening of the left side plate is not shown). Around the opening 43 formed on the right side plate, as shown in FIG. 6, a hole part 44 concaved upwardly is formed in a lower part and a locking piece 45 extending in the left direction is formed above the hole part 44.

Moreover, as shown in FIG. 5, in the bottom plate of the container main body 30, a partition wall 46 extending in the left and right directions is erected to divide a space into a front supply chamber 47 and a rear agitation chamber 48. At left and right end parts of the partition wall 46, communication ports are formed. In addition, in a left end part of the agitation chamber 48, a conduction part 49 communicating with the toner container 6 is formed so that the toner is replenished via the conduction part 49 from the toner container 6 to the left end part of the agitation chamber 48.

The first agitating screw 31 and the second agitating screw 32 are supported in the supply chamber 47 and the agitation chamber 48 so as to rotate around an axial direction. Thereby, the toner supplied from the toner container 6 is mixed and agitated with carrier and electrically charged by a predetermined charge amount.

The magnet roller 33 is composed of, as shown in FIG. 7, a shaft 52 in which a plurality of magnets 51 are arrayed in a circumferential direction thereof and a nonmagnetic rotation sleeve 53 incorporating the shaft 52. Each magnet 51 has a fanwise sectional shape and the magnets 51 are disposed along the circumferential direction of the shaft 52 in predetermined polarity sequence. In a right end part of the shaft 52, a D-cut face 54 (engaged part) is formed by cutting away a part of the outer circumferential face thereof in parallel with the axial direction of the shaft 52.

A left end part and the right end part of the shaft 52 are respectively supported to the rotation sleeve 53 by left and right flange members 55 and 56. The left flange member 55 is fitted into and fixed by a left opening of the rotation sleeve 53. On an outside face of the left flange member 55, an axial part 58 extending coaxially with the shaft 52 is formed. On an inside face of the left flange member 55, a bearing part 59 rotatably supporting a left end of the shaft 52 is formed.

The right flange member 56 is fitted into and fixed by a right opening of the rotation sleeve 53 and an opening 61 is formed coaxially with the shaft 52. Along an inner circumferential face of the opening 61, a bearing part 62 is formed. In addition, on a right side face of the right flange member 56, a cylindrical shaft part 63 is formed so as to extend coaxially with the shaft 52 from the circumference of the opening 61. The right end part of the shaft 52 is inserted into the cylindrical shaft part 63 from the opening 61 through the bearing part 62, and the D-cut face 54 is projected to the outside from the cylindrical shaft part 63.

As shown in FIGS. 3 and 4, to the axial part 58 of the left flange member 55 and the cylindrical shaft part 63 of the right flange member 56, DS rollers 65 and 66 are rotatably supported through bearings 67 (refer to FIG. 8, the bearing for the DS roller 65 is not shown). Each of the DS rollers 65 and 66 has an outer diameter slightly larger than an outer diameter of the rotation sleeve 53. When the development device 11 is attached to the printer main body 2, the respective DS rollers 65 and 66 come into contact with outsides of a latent image forming area of the photosensitive drum 9 to form a predetermined gap between the photosensitive drum 9 and the rotation sleeve 53.

As shown in FIGS. 3 and 5, the magnet roller 33 is located in the concave part 42 of the container main body 30 so that a part of a surface thereof is exposed out of the opening part 41 formed on the front side plate of the container main body 30. Then, the shaft part 58 of the left flange member 55 and the cylindrical shaft part 63 of the right flange member 56 are rotatably supported by the circumferences of the openings 43 formed on the left and right side plates of the container main body 30 through bearings 69 (refer to FIG. 8, the bearing for the left flange member is not shown), respectively.

The restricting blade 34 is a plate member elongated in the left and right directions and is supported at an upper side of the opening part 41 of the container main body 30 so that a predetermined gap is formed from the magnet roller 33. A thickness of a layer of the developer carried on the magnet roller 33 is restricted when the rotation sleeve 53 is rotated and the developer is passed through the gap between the restricting blade 34 and the magnet roller 33, and then, a developer thin layer of several hundred microns is formed on a surface of the rotation sleeve 53.

The restricting blade 34 is electrically connected with the shaft 52 of the magnet roller 33 through a spring member 70. The spring member 70 is formed, as shown in FIG. 11, by winding a conductive wire and includes a winding part 71 at the center, a bent part 72 provided at one end, and a coil part 73 provided at another end. The winding part 71 is formed by winding a center part of the wire by two to three times and a part thereof is formed as a straight part 75 engaging with the D-cut face 54. The bent part 72 is formed by extending the one end of the wire straightly along a tangential direction of the winding part 71 and bending the one end into a rectangular wave-like shape in an intersecting direction with an axial direction of the winding part 71. The coil part 73 is formed by intersecting the other end of the wire with the one end, extending the other end straightly along a tangential direction of the winding part 71, and then, winding the other end into a coil spring-like shape in an intersecting direction with the axial direction of the winding part 71. The coil part 73 has elasticity in an axial direction. The one end and the other end of the wire are intersected with each other by an obtuse angle. In addition, between the winding part 71 and the coil part 73, an intermediate part 76 bent into a two stepwise-like shape is formed.

The spring member 70 is, as shown mainly in FIG. 6, attached so that the winding part 71 is externally fitted around the right end part of the shaft 52 and the straight part 75 is engaged with the D-cut face 54 of the shaft 52. In addition, the bent part 72 is extended downwardly from the winding part 71 and is locked at the opening of the hole part 44 formed around the opening 43 of the right side plate of the container main body 30. The coil part 73 is extended to an obliquely upper backward side from the winding part 71 and the intermediate part 76 is locked by a locking piece 45 formed around the opening 43, and then, the coil part 73 elastically comes into contact with a rear face of the restricting blade 34. That is, the spring member 70 electrically comes into contact with the shaft 52 and the restricting blade 34. It is noted that the shaft 52 is temporarily and elastically held to the container main body 30 by the spring member 70 and is not positioned accurately. Moreover, a forward bias force is applied to the winding part 71 with respect to the bent part 72 and the coil part 73.

The left and right cover members 35 and 36 are made of a resin material, e.g. such as ABS resin, and are attached to the outsides of the openings 43 formed on the left and right side plates of the container main body 30, respectively. To the left side face of the left cover member 35, a rotating shaft 81 engaging with the shaft part 58 of the left flange member 55 is rotatably supported. The rotating shaft 81 is engaged with a guide hole 15*a* formed on the left side plate of the printer main body 2 and is also connected with a driving source (not shown), such as a motor. In response to the rotation of the rotating shaft 81 driven by the driving source, the left flange member 55 is rotated centering on the rotating shaft 81. Thereby, the rotation sleeve 53 fixed to the left flange member 55 is rotated together with the right flange member 56.

On the right cover member 36 is, as shown in FIG. 8, a hollow boss-like bearing part 83 formed is coaxially with the shaft 52 of the magnet roller 33 so as to project to the outside. The bearing part 83 has an inner diameter larger than an outer diameter of the shaft 52. The bearing part 83 is engaged with the guide hole 15*a* formed on the right side plate of the printer main body 2.

On an inner circumferential face of the bearing part 83, as shown in FIGS. 9B and 10, an engaging piece 85 is formed so as to bridge along a circumferential direction. The engaging piece 85 is bridged approximately between a quarter of the inner circumferential face of the bearing part 83 and includes a pair of leg parts 86 extending radially from the inner circumferential face and a plate part 87 provided between distal ends of the both leg parts 87. Each leg part 86 has a length of a approximately half of a radius of the bearing part 83. In the plate part 87, a flat surface 88 (engaging part) in parallel with the axial direction of the shaft 52 if formed on an opposite face to the inner circumferential face of the bearing part 83. According to the present embodiment, the engaging piece 85 is formed on the front inner circumferential face of the bearing part 83, and the flat surface 88 is extended in a vertical direction.

As shown in FIG. 8, when the right cover member 36 is attached, a distal end of the cylindrical shaft part 63 of the right flange member 56 is fitted into the bearing part 83. Then, the D-cut face 54 formed at the end part of the shaft 52 projected from the cylindrical shaft part 63 comes into face contact with the flat surface 88 of the engaging piece 85. Thereby, the predetermined magnet 51 provided in the shaft 52 is positioned so as to face to the restricting blade 34. In addition, between the outer circumferential face of the shaft 52, other than the D-cut face 54, and the inner circumferential face of the bearing part 83, a clearance C is made.

When the development device 11 constructed as described above is attached to the printer main body 2, the rotating shaft 81 of the left cover member 35 and the bearing part 83 of the right cover member 36 are engaged with the guide holes 15*a* formed on the left and right side plates of the printer main body 2, and then, the development device 11 is slid in a direction of the photosensitive drum 9 along the guide holes 15*a*. That is, the development device 11 is guided toward the photosensitive drum 9 from a direction orthogonal to the axial direction of a spindle 9*a* of the photosensitive drum 9 (in an approaching direction to the photosensitive drum 9), and then, the development device 11 approaches the photosensitive drum 9. When the rotating shaft 81 and the bearing part 83 respectively reach end parts of the guide holes 15*a*, the DS rollers 65 and 66 provided on the both sides of the magnet roller 33 comes into contact with the outsides of the latent image forming area of the photosensitive drum 9 from the obliquely right upper side, and a slight gap is formed between the photosensitive drum 9 and the rotation sleeve 53. In addition, the development device 11 is supported by the guide plates 15.

Meanwhile, on the rotating shaft 81 and the bearing part 83, a force F (indicated by a blanked arrow in FIG. 10) in which a reaction force received by the DS rollers 65 and 66 from the photosensitive drum 9 and a reaction force of the guide holes 15*a* to the side faces are combined acts on the rotating shaft 81 and the bearing part 83. The contact faces of the D-cut face 54 and the flat surface 88 are provided along (in parallel with) an action direction of this force F.

While the bearing part 83 is tilted downwardly when the force F is applied to the bearing part 83, the contact state of the flat surface 88 and the D-cut face 54 is kept because the contact face of the flat surface 88 and the D-cut face 54 is provided along the action direction of the force F and there is no influence on the positioning of the magnets 51. In addition, because the clearance C is made between the inner circumferential face of the bearing part 83 and the outer circumferential face of the shaft 52 at an upstream side from the contact face of the flat surface 88 and the D-cut face 54, the bearing part 83 does not come into contact with the shaft 52 and the force F applied to the bearing part 83 is not applied to the shaft 52 even if the bearing part 83 is tilted due to the force F. Incidentally, it is not preferable because the positioning of the magnet 51 may not be accurately made if the contact face of the flat surface 88 and the D-cut face 54 is not provided along the action direction of the force F and if the force F is applied to the bearing part 83 to separate the flat surface 88 downwardly from the D-cut face 54.

When the development device 11 is attached, a high-voltage power supply terminal is inserted, from a side of the printer main body 2, into the hole part 44 formed around the opening 43 of the right side plate of the container main body 30. The high-voltage power supply terminal comes into contact with the bent part 72 of the spring member 70, and a high-voltage power is applied to the shaft 52 of the magnet roller 33 and the restricting blade 34 from the high-voltage power supply terminal through the spring member 70. Thus, potential of the shaft 52 is equalized with that of the restricting blade 34.

In response to a start of a developing operation, the first agitating screw 31 and the second agitating screw 32 of the container main body 30 are rotated, and the developer is agitated and circulated through the supply chamber 47 and the agitation chamber 48 to electrically charge the toner. The charged toner is then conveyed to the concave part 42 of the container main body 30. Inside the concave part 42, the rotating shaft 81 of the left cover member 35 is rotated by the driving source, and the shaft part 58 of the left flange member 55 is rotated together with the rotating shaft 81. Thereby, the rotation sleeve 53 is rotated together with the right flange member 56, and the toner is carried on the surface of the rotation sleeve 53 by magnetic force.

The toner carried on the surface of the rotation sleeve 53 is then conveyed toward the restricting blade 34. Since the predetermine magnet 51 faces to the restricting blade 34, a distal end of the restricting blade 34 is induced by an opposite polarity to a polarity of the magnet 51, and a magnetic field in a direction of attracting each other is generated between the restricting blade 34 and the rotation sleeve 53. Due to this magnetic field, on the surface of the rotation sleeve 53, a magnetic brush in which a thickness of a layer is restricted is formed. The magnetic brush is conveyed to an opposite area to the photosensitive drum 9 by rotation of the rotation sleeve 53. Due to a potential difference between the photosensitive drum 9 and the magnet roller 33, the toner is flown to develop the electrostatic latent image on the photosensitive drum 9.

As described above, in accordance with the development device 11 of the present disclosure, since the force applied to the bearing part 83 of the development device 11 from the guide holes 15*a* does not influence the shaft 52 of the magnet roller 33 when the development device 11 is attached to the printer main body 2, it is possible to reduce a deflection of the shaft 52. Therefore, it is possible to adjust the position of the magnets 51 of the magnet roller 33 by using the inexpensive resin-made left and right cover members 35 and 36 requiring no metal mold. Thus, the cost can be cut further. Then, since the deflection of the shaft 52 is thus reduced, the gap between the magnet 51 and the rotation sleeve 53 can be set small, and accordingly, it is possible to readily cause the magnetic force of the magnets 51 to exert on the developer carried on the surface of the rotation sleeve 53. Therefore, it is possible to enhance the force (magnetic force) carrying the developer on the surface of the rotation sleeve 53 and thus to stabilize the developing works.

Still further, since the end part of the shaft 52 is temporarily held by the spring member 70 when the right cover member 36 is attached, it is possible to readily fit the bearing part 83 of the right cover member 36 into the end part of the shaft 52. By providing the straight part 75 in the winding part 71 of the spring member 70, since the D-cut face 54 of the shaft 52 and the flat surface 88 of the bearing part 83 can be readily positioned with each other when the cover members 35 and 36 are attached, it is possible to more readily attach the cover members 35 and 36.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

an image carrier rotatably supported centering on a spindle;

a development device developing an electrostatic latent image formed on the image carrier; and a guide part guiding the development device in an approaching direction to the image carrier in a direction orthogonal to an axial direction of the spindle, wherein the development device includes:

a magnet roller including a shaft on which magnets are arrayed along a circumferential direction and a rotation sleeve incorporating the shaft to carry a developer on a surface of the rotation sleeve by a magnetic force of the magnets; and a cover member includes a bearing part formed into a hollow boss-like shape projecting to the outside in an axial direction of the shaft and the bearing part is engaged with the guide part and, into the bearing part, an end part at the outside in the axial direction of the shaft is inserted, the end part of the shaft and the bearing part respectively include an engaged part and an engaging part, the engaged part and the engaging part include respective contact faces provided along an action direction of a force acting from the guide part to the bearing part when the bearing part is engaged with the guide part and the development device approaches the image carrier, the contact faces of the engaged part and the engaging part come into contact with each other so as to restrict positions of the magnets in the circumferential direction of the shaft the development device is configured so that a clearance is provided between an outer circumferential face of the end part of the shaft and an inner circumferential face of the bearing part surrounding the outer circumferential face at an upstream side from the contact faces in the action direction of the force.

2. The image forming apparatus according to claim 1, wherein the engaged part is a D-cut face formed by cutting away a part of an outer circumferential face of the shaft in parallel with the axial direction of the shaft, the engaging part is a flat surface formed in parallel with the axial direction of the shaft on an opposite face to the inner circumferential face of the bearing part of an engaging piece bridged along a circumferential direction of the inner circumferential face of the bearing part, the D-cut face and the flat surface are formed to be in parallel with the action direction of the force.

3. The image forming apparatus according to claim 1, wherein the development device further includes:

a restricting blade restricting a thickness of a layer of the developer carried on the magnet roller; and a spring member including a winding part by which the end part of the shaft is supported and a coil part coming into contact with the restricting blade, wherein the development device is configured so that voltage is applied to the shaft and the restricting blade through the spring member.

4. The image forming apparatus according to claim 3, wherein the winding part has a straight part formed so as to engage with the engaged part of the shaft.

5. The image forming apparatus according to claim 3, wherein the spring member is formed by winding a conductive wire and includes the winding part provided at the center of the wire, a bent part provided at one end of the wire, and the coil part provided at another end of the wire, the bent part is disposed through an opening of a container main body of the development device, the coil part is disposed so as to come into contact with the restricting blade.

6. The image forming apparatus according to claim 1 comprising:

guide holes formed respectively in left and right guide plates provided on left and right side plates of an apparatus main body, wherein the development device further includes a rotation shaft rotating the rotation sleeve, the guide part is one guide hole and the rotation shaft is engaged with the other guide hole.

* * * * *